US006311658B2

(12) United States Patent
Eguchi

(10) Patent No.: US 6,311,658 B2
(45) Date of Patent: Nov. 6, 2001

(54) VALVE TIMING CONTROL DEVICE

(75) Inventor: Katsuhiko Eguchi, Kariya (JP)

(73) Assignee: Aisin Seiki Kabushiki Kaisha, Aichi-Pref (JP)

( * ) Notice: Subject to any disclaimer, the term of this patent is extended or adjusted under 35 U.S.C. 154(b) by 0 days.

(21) Appl. No.: 09/850,298

(22) Filed: May 8, 2001

Related U.S. Application Data

(62) Division of application No. 09/431,252, filed on Nov. 1, 1999.

(30) Foreign Application Priority Data

Oct. 30, 1998 (JP) ..... 10-310309

(51) Int. Cl.[7] ..... F01L 1/34
(52) U.S. Cl. ..... 123/90.17
(58) Field of Search ..... 123/90.15, 90.17, 123/90.31; 74/568 R; 464/1, 2, 160

(56) References Cited

U.S. PATENT DOCUMENTS 4,895,113 * 1/1990 Speier et al. ..... 123/90.17
4,903,650 * 2/1990 Ohlendorf et al. ..... 123/90.17
5,088,456 * 2/1992 Suga ..... 123/90.17
5,113,814 * 5/1992 Suga et al. ..... 123/90.17
5,201,289 * 4/1993 Imai ..... 123/90.17
5,205,249 * 4/1993 Markley et al. ..... 123/90.17
5,263,442 * 11/1993 Hara ..... 123/90.17
5,309,873 * 5/1994 Suga et al. ..... 123/90.17
5,450,825 * 9/1995 Geyer et al. ..... 123/90.17

FOREIGN PATENT DOCUMENTS 9-280019 10/1997 (JP) .

* cited by examiner

*Primary Examiner*—Weilun Lo
(74) *Attorney, Agent, or Firm*—Reed Smith Hazel & Thomas LLP

(57) ABSTRACT

A valve timing control device for securing a rotor to a cam shaft wherein a bolt member is used which is to be coupled thereto is disclosed. The bolt member has a built-in spool valve. Between the spool valve and a rod of an electromagnetic actuator, there is provided an adjusting member for controlling axial displacement of the spool valve. Such a structure facilitates an assembly operation of the valve timing control device.

17 Claims, 4 Drawing Sheets

VALVE TIMING CONTROL DEVICE

This application is a divisional application based on the non-elected claim 2 of the pending application Ser. No. 09/431,252 filed on Nov. 1, 1999,

BACKGROUND OF THE INVENTION

1. Field of the Invention

The present invention is directed to a valve timing control device and in particular to a valve timing control device for controlling an angular phase difference between a crank shaft and a cam shaft of an internal combustion engine.

2. Prior Art

Japanese Utility Model Laid-open Print No. Hei.9-280019 published on Sep. 28, 1997 without examination discloses a conventional valve timing control device. This valve timing control device includes a rotational member rotating together with a cam shaft of an internal combustion engine, a rotation transmission member rotating together with a crank shaft of the internal combustion engine and connected to the rotational member so as to be rotated relative to the rotational member, a plurality of vanes extending into plural concave portions, respectively, in such manner that each vane defines an advancing angle chamber and a retarding angle chamber in the corresponding concave portion, a cylinder fixedly fitted in an inner bore of the rotational member, and a control valve fitted movably in axial direction in a bore of the cylinder and controlling the amount of fluid from a fluid source to both the advancing and retarding angle chambers by being driven by an electromagnetic mechanism secured to the internal combustion engine.

If the control valve if moved in one direction (the other direction) with manipulation of the electromagnetic mechanism, a fluid supply to the advancing chamber and a fluid drain from the retarding chamber are established concurrently (a fluid drain from the advancing chamber and a fluid supply to the retarding chamber are established concurrently), which causes concurrent rotations of the rotational member and the rotation transmission member in one direction (the other direction), an angular phase of the crank shaft is advanced (retarded) relative to an angular phase of the cam shaft. Thus, the timing of a valve connected to the cam shaft becomes more advanced (retarded).

However, in the foregoing structure, a first connecting member is required to connect between the rotational member and the cam shaft. In addition, a second connecting member is essential for the connection between the inner bore of the rotational member and the cylinder accommodating therein the control valve. Such first connecting member and second connecting member cause an increase of the number of parts which results in an increase of the production cost of the valve timing control device in addition to the fact that the members act as barriers against an easy and quick assembly of the valve timing control device.

Moreover, in the foregoing structure, when the valve timing control device is fixed to the internal combustion engine, axial movement of the control valve has to be adjusted in such a manner that a distal end portion of the control valve which extends toward the electromagnetic mechanism has to be coupled with a movable member in screw manner which is formed of magnetic material. Such an engagement multiplies the complexity of the assembly of the device.

Accordingly, a need exists for a valve timing control device without the foregoing drawbacks.

SUMMARY OF THE INVENTION

The present invention has been developed to satisfy the need noted above and thus has as a primary object the provision of a valve timing control device which comprises:

a rotational member which rotates together with a cam shaft of the internal combustion engine during running thereof;

a rotation transmission member mounted on the rotational member so as to rotate relative thereto and rotating together with a crank shaft of the internal combustion engine;

a phase adjusting mechanism which adjusts a rotational phase of the rotational member relative to a rotational phase of the rotation transmission member based on a magnitude of the fluid pressure;

a regulating valve which controls the magnitude of the fluid pressure supplied to the phase adjusting mechanism; and a connecting member accommodating therein the regulating valve and connecting between rotational member and the cam shaft.

BRIEF DESCRIPTION OF THE DRAWINGS

The above and other objects, features and advantages of the present invention will be more apparent and more readily appreciated from the following detailed description of preferred exemplary embodiments of the present invention, taken in conjunction with the accompanying drawings, in which.

DETAILED DESCRIPTION OF THE PRESENT INVENTION

A preferred embodiment of the present invention will be described hereinafter in detail with reference to the accompanying drawings.

Figure 1:
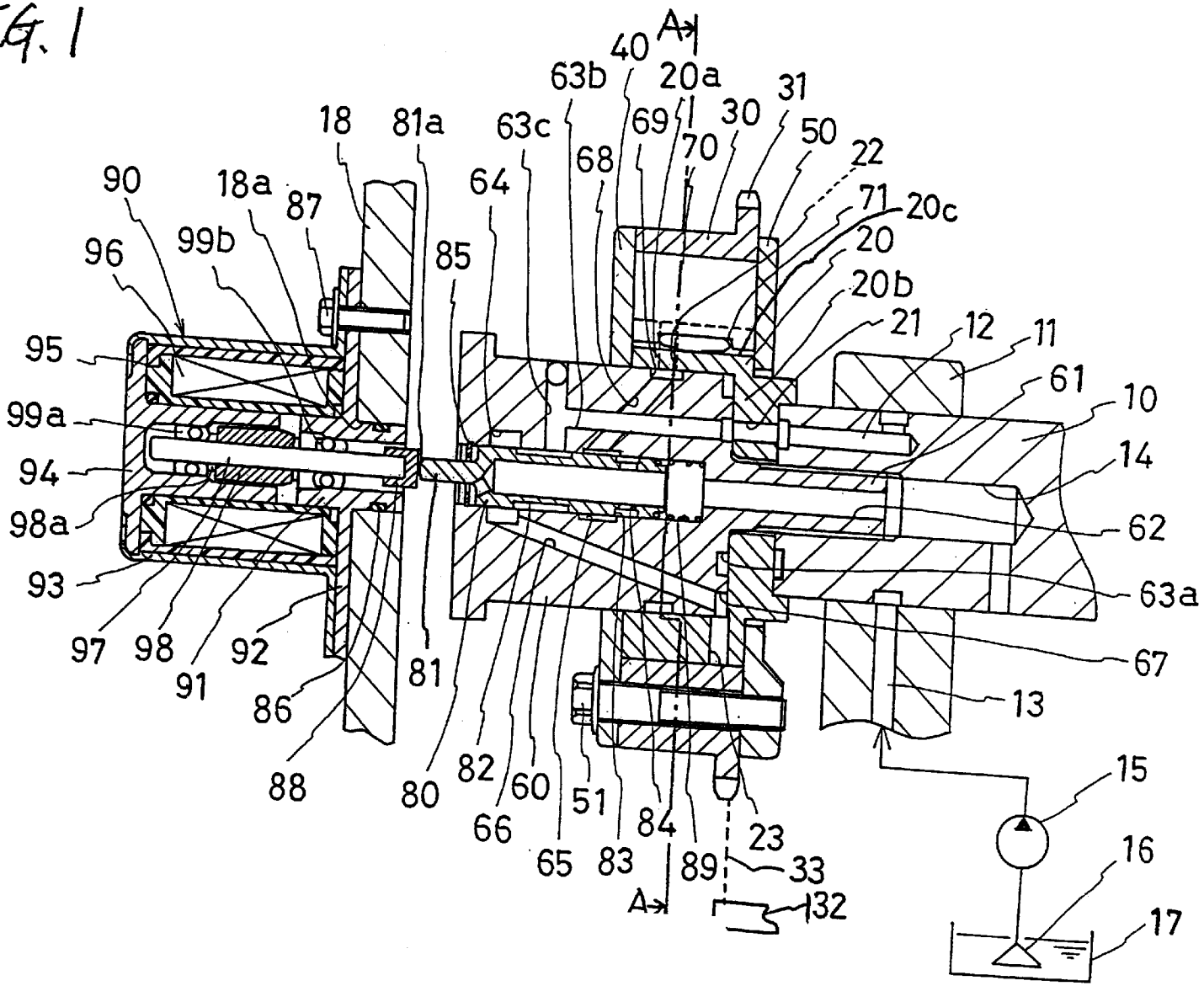
FIG. 1 is a vertical gross-sectional view of a valve timing control device in accordance with an embodiment of the present invention.
Figure 2:
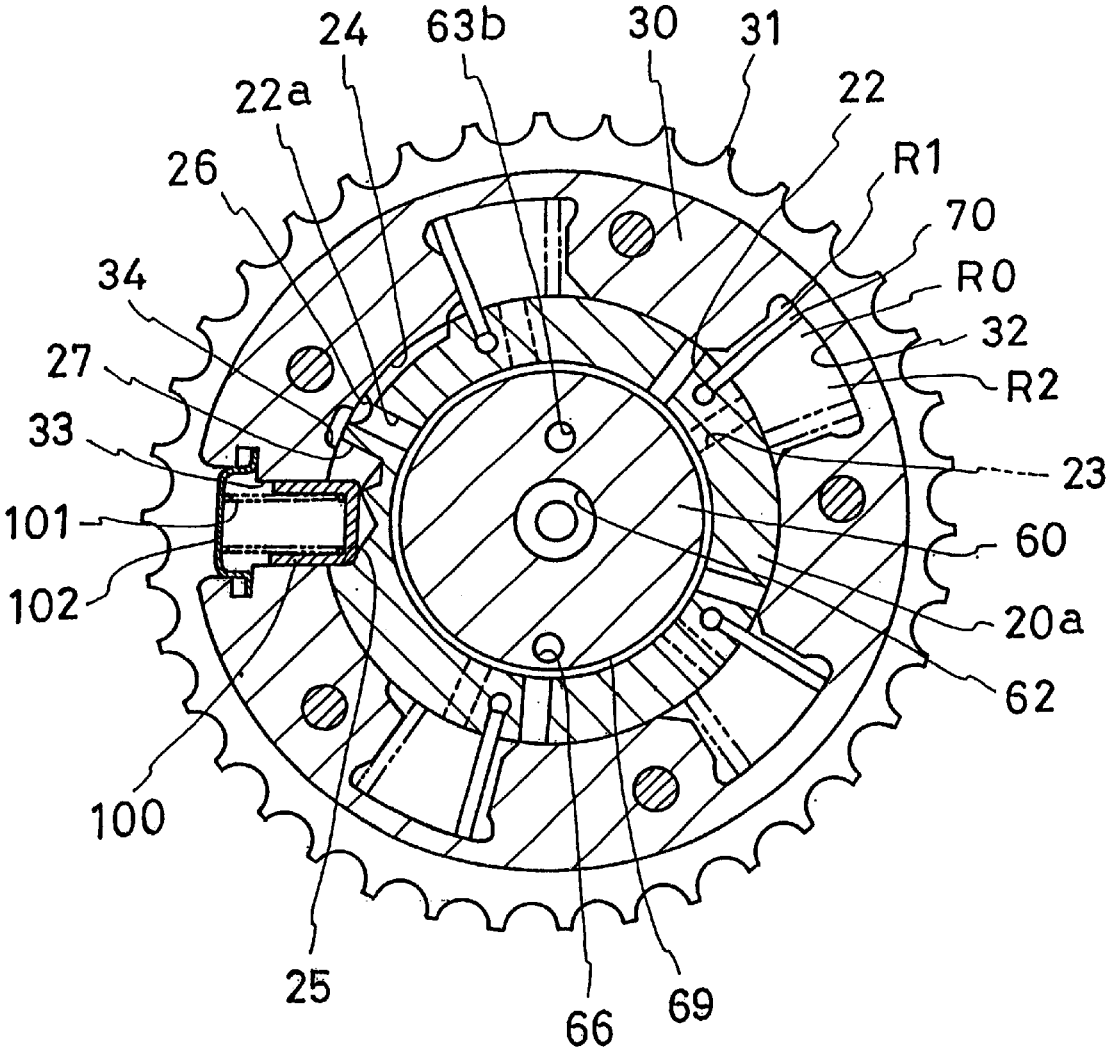
FIG. 2 is a cross-sectional view of the device taken along line A—A in FIG. 1.

First of all, with reference to FIGS. 1 and 2, there is illustrated a valve timing control device in accordance with an embodiment of the present invention. The valve timing control device includes a rotor 20 as a rotational member which is coupled to a distal end of a cam shaft 10 which is journaled in a cylinder head 11 of an internal combustion engine. The valve timing control device also includes a housing 30 so mounted on the rotor 20 as to be rotated relative thereto, a front plate 40, a rear plate 50, and timing sprockets 31 formed on the housing 30 integrally therewith. These members 30, 31, 40, and 50 constitute a rotation transmission mechanism. The valve timing control device further includes four vanes 70 arranged on the rotor 20, a spool valve 80 accommodated in a bolt member 60 which is used to secure the rotor 20 to the distal end of the cam shaft 10, a locking pin 100 provided in the housing 30, and other members or elements. It is to be noted that is as well known, a rotational torque for rotating the housing 30 in the clockwise direction in FIG. 2 is transmitted to the timing sprockets 31 from the crank shaft 132 by way of crank sprockets, and a timing chain 33.

The cam shaft 10 is provided thereon with cams (not shown) which open and close114 intake valves (not shown) as is well known. In the cam shaft 10, a supply passage 12 and a drain passage 14 are formed so as to extend in the axial direction in parallel. One end of the supply passage 12 is in fluid communication with an oil pump 15 by way of a radial passages in the cam shaft and a connecting passage 13 formed in the cylinder head 11, while the other end of the supply passage 12 terminates in an annular groove formed in the distal end of the cam shaft 10. One end of the drain passage 14 is in fluid communication with an inside portion of the cylinder head 11 via a radial passage formed in the cam shaft 10. It is to be noted that as well known, the oil pump 15 is driven by the internal combustion engine and the oil pump 15 in operation sucks an operating oil or fluid stored in an oil pan or reservoir 17 and discharges the same into the connecting passage 13.

The rotor 20 includes a cylinder portion 20*a* which extends in the axial direction and a flange portion 20*b* which extends from one end of the cylinder portion 20*a*. The rotor 20 is fixedly secured to the cam shaft 10 in such a manner that the flange portion 20*b* is held between the distal end of the cam shaft 10 and a head of the common bolt member 60 driven into the distal end of the cam shaft 10. The flange portion 20*b* of the rotor 20 is provided therein with an axial passage 21 which is in fluid communication with the supply passage 12 via a part of the annular groove.

The bolt member 60 is formed therein with a stepped bore 62 which is in fluid communication with the drain passage 14. Along an inner surface of a large diameter portion of the stepped bore 62, there are provided axially spaced annular grooves 64 and 65 from the left to the right. A small diameter portion 61 of the bolt member 60 is screwed into the drain passage 14 and a larger diameter portion is fitted in the cylinder portion 20*b* of the rotor 20 with a clearance. The stepped portion of the bolt member 60 which cooperates with the distal end of the cam shaft 10 for holding therebetween the flange portion 20*b* of the rotor 20 is provided with an annular groove 63*a* which is opposite the passage 21 and an annular groove 67 which opens outwardly. The head or larger diameter portion of the bolt member 60 has therein an axially extending passage 63*b* which is in fluid communication with the annular groove 63*a,* a radially extending passage 63*c* in which the other end of the passage 63*b* terminates, the passage 63*c* being terminated in between the grooves 64 and 65, an outer annular groove 69, a passage 68 connecting between the annular grooves 65 and 69, and a passage 66 connecting between the annular grooves 64 ad 67. It is to be noted that an outer radial end of the passage 63*c* is fitted therein with a ball for a closure thereof.

The rotor 20 is provided therein with four grooves 20*c* in which the respective vanes 70 are fitted so as to be moved in the radial direction. As can be understood from FIG. 2, the rotor 20 includes a bore 25 into which a lock pin 100 is fitted when the phase or angular position of each of the cam shaft 10 and the rotor 20 relative to the housing 30 becomes a set value which is indicative of a most retarded angle, a passage 22*a* which allows a fluid communication between the bore 25 and the annular groove 69, a passage 22 which allows a fluid communication between the annular groove 69, and each of advancing angle chamber R1 (except for the upper one) defined by the corresponding vane 70, a passage 23 which allows a fluid communication between the annular, groove 67 and each of retarding angle chamber R2 defined by the corresponding vane 70, and an axially extending groove 26 connected to the passage 22*a*. It is to be noted that through the groove 24, the oils are supplied to and drained from the uppermost advancing angle chamber R1. In addition, the outer surface of the rotor 20 is formed with a bore 27 which allows a fluid communication between the groove 26 and the bore 25 at the outer surface of the housing 30 via the groove 34. It is to be noted that each vane 70 is urged outwardly in the radial direction by a vane spring 71 as depicted in FIG. 1 which is interposed between each vane 70 and a bottom of the corresponding vane groove 21. The bore 25 has a radius which is set to be slightly larger than an outer radius of the locking pin 100 and an inner radius of an escaping or a sheltering bore 33 as will be detailed later.

The housing 30 is so mounted on the rotor 20 as to be rotatable relative thereto within an angular range. The front plate 40 and the rear plate 50 are provided at opposite ends of the housing 30, respectively, and these three members are fastened together by five bolts 51 which are arranged in equi-spaced manner in the circumferential direction to establish a unitary structure. As mentioned above, the sprockets 31 are integrated with the outer surface of the housing 30 so as to be adjacent to the rear plate 50. Four concave portions 32 are formed along an inner surface of the housing 30 it such a manner that each of the concave portions 32 opens toward an axis of the housing 30 and portions between two adjacent concave portions 32 are in sliding engagement with the outer surface of the rotor 20. One of the portions is provided therein with the escaping bore 33 extending in the radial direction and accommodating the locking pin 100 and a spring 101 urging the locking pin 100 toward the rotor 20. The front plate 40 and the rear plate 50 are configured to be in circular shape.

In the larger radius portion of the inner bore 62 of the bolt member 60, the spool valve 80 is fitted in slidable manner. The spool valve 80 is in the form of a hollow cylinder with its end closed by a bottom from which a projection 81 is projected outwardly in the axial direction. The spool valve 80 is urged by a spring 89 disposed between an open end side of the spool valve 80 and a stepped portion of the stepped bore 62 so as to be projected outside the bolt member 60. An extraction of the spool valve 80 under biasing of the spring 89 is prevented by a snap ring 85 fitted in an opening of the stepped bore 62. An outer surface of the spool valve 80 is formed therein with an annular groove 82. The groove 82 is in continual fluid communication with the passage 63 and is brought into fluid communication with either of the annular grooves 63 and 63 depending on axial displacement of the spool valve 80. In addition, the outer surface of the spool valve 80 is formed therein with an annular groove 83 which is in continual communication with the passage 68. The groove 83 which allows depending on the displacement of the spool valve 80 to connect the passage 68 to the drain passage 14 by way of the passage 84 and the inner bore 62 of the spool valve 80. It is to be noted that the annular groove 64 is set to be in fluid communication with the inner bore 62 depending the axial displacement of the spool valve 80 and an aperture is formed in the bottom of the spool valve 80.

Between the front plate 40 and the rear plate 50, each concave portion acts as a fluid pressure chamber R0 and is divided by the corresponding vane 70 into the advancing angle chamber R1 and the retarding angle chamber R2 and as can be seen from FIG. 2 engaging each vane 70 with either side walls in the circumferential direction regulating limits of relative phase.

The locking pin 100 is so fitted in the escaping bore 33 a to be moveable in the axial direction and is urged by the spring 101 toward the rotor 20 which is interposed between the locking pin 100 and a retainer 102. The retainer 102 has at its four corners projections which are fitted in a groove at opening side of the bore 33, whereby the retainer 102 is in all directions. Thus, when the cam shaft 10 and the rotor 20 are in synchronization with the housing 30 at a relative phase or the most retarded angle, a head portion of the locking pin 100 is fitted by an amount in the bore 25, thereby regulating the relative movement between the rotor 20 and the housing 30.

Figure 3:
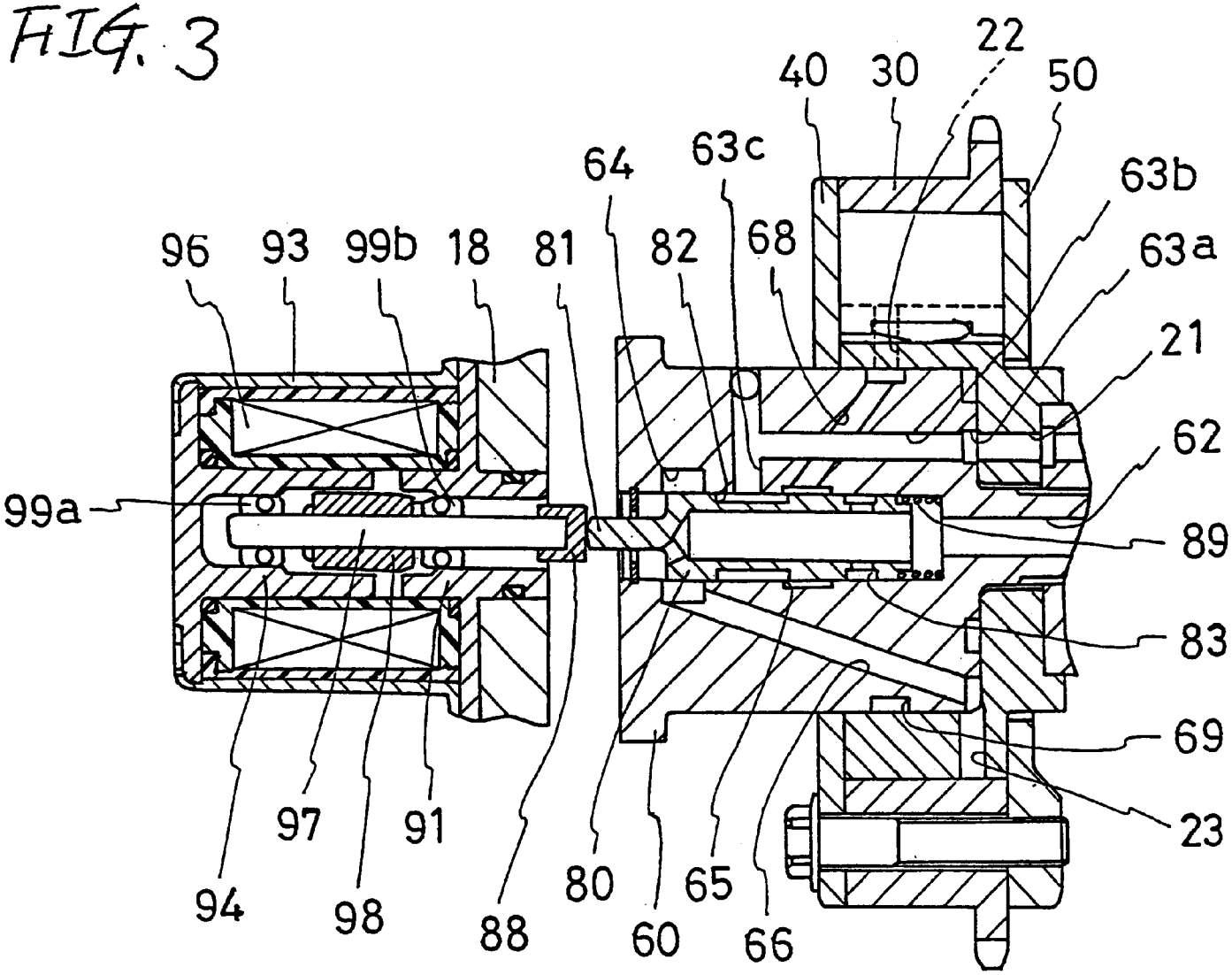
FIG. 3 is a view similar to FIG. 1 when a spool valve is at an advancing angle position for allowing fluid flow into only advancing angle chambers.
Figure 4:
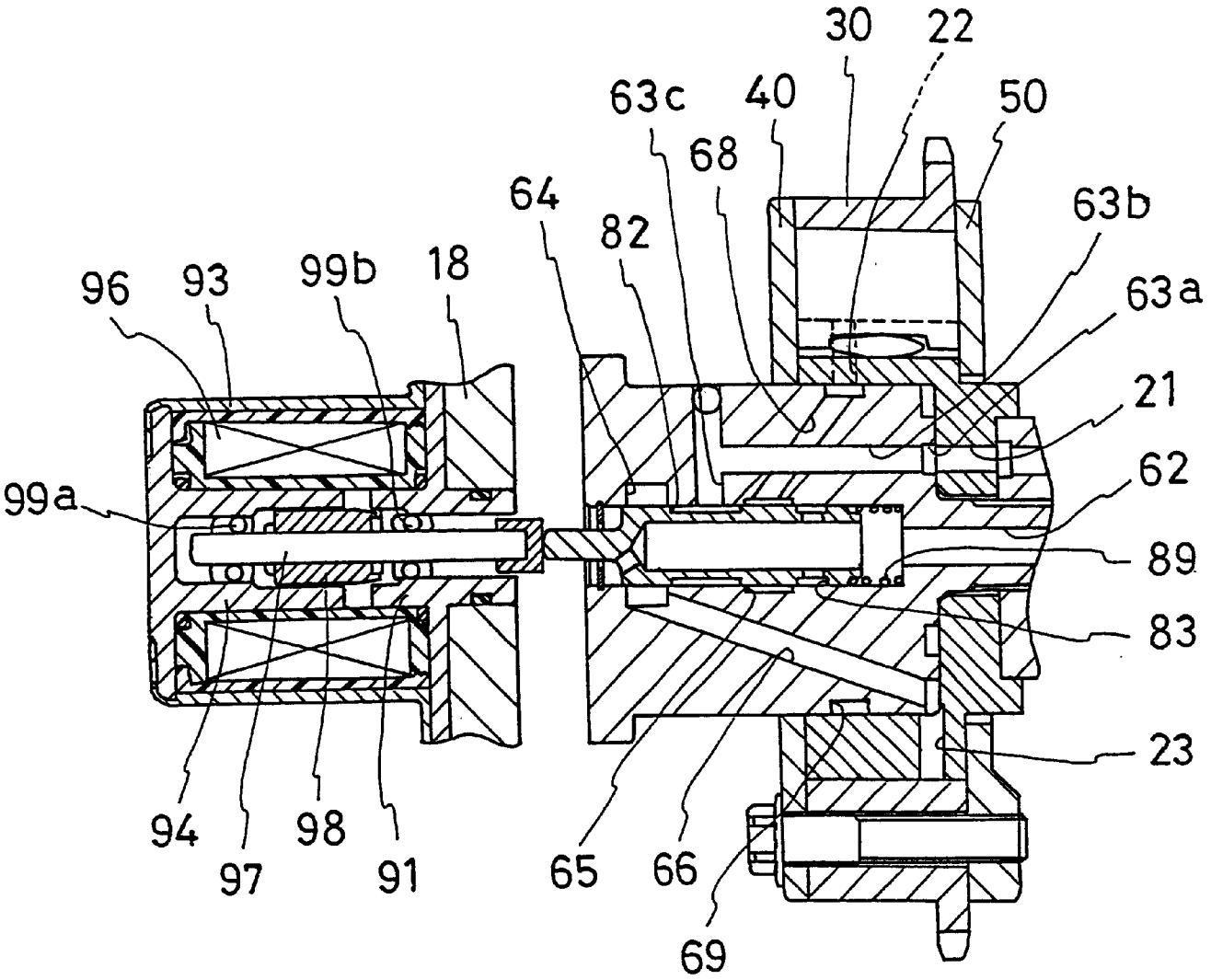
FIG. 4 is a view similar to FIG. 1 when the spool valve is at a holding position for not allowing fluid low into both of advancing angle and retarding angle chambers.

An electromagnetic mechanism 90 includes a movable core 98 which is attracted to a stationary core 91 when a coil 96 is energized. On the movable core 98, there is fixedly mounted a rod 97. The rod 97 is provided at its distal end thereof with an adjusting member 88 which abuts the projection 81 of the spool valve 80. Thus, when the coil 96 is energized, the rod 97 urges, via the adjusting member 88, the spool valve 80 against the spring 89 in the rightward direction. A controller (not shown) adjusts an amount of electric current supplied to the coil 96 depending on running condition of the internal combustion engine in duty control. When the coil 96 is inactive or the duty ration is 0%, the movable core 98 is at its initial position at which a stopper 98*a* is in engagement with a bearing 99*a,* and the spool valve 80 is retained at the retarded angle position as shown in FIG. 1. At the retarded angle position, the spool valve 80 allows a fluid communication between the passages 63*c* and 66 via the annular groove 82 and allows a fluid communication between the passage 68 and the bore 62 via the annular groove 83, with the result that the advancing angle chambers R1 and the retarding angle chambers R2 are brought into fluid communication with the drain passage 14 and the supply passage 12, respectively. On the other hand, an electric current at a duty ratio of 100% is applied to the coil 96. The movable core 96 is attracted toward the stationary core 91, by which the rod 97 moves the spool valve 80 toward the cam shaft 10 against the spring 89 in such a manner that the spool valve 80 makes its full stroke, thereby holding the spool valve 80 at the advancing angle position as shown in FIG. 3. At the advancing angle position, the spool valve allows a fluid communication between the passages 63*c* and 68 via the annular groove 82 and also allows a fluid communication between the outer end side of the passage 66, whereby the advancing angle chamber R1 and the retarding angle chamber R2 are brought into fluid communication with the supply passage 12 and both of the drain passage 14 and the inner side of the front cover 18, respectively. In addition, in case of 50% duty ratio current supply to the coil 96, the spool valve 80 is held at its retaining position as shown in FIG. 4. Under such a condition shown in FIG. 4, the spool valve 80 interrupts the fluid communication between the bore 62 and each of the passages 68 and 66.

In the foregoing structure, while the internal combustion engine is stopped, the oil pump 15 and the coil 96 of the electromagnetic mechanism 90 are inactive, the locked condition results as shown in FIG. 2 under which relative rotation between the rotor 20 and the housing 30 is regulated at the most retarded angle position which is established when the locking pin 100 fits into the bore 25. Under the locked condition, if initiation of the internal combustion, driving the oil pump 15, and current supply to the coil 96 at a duty rate of 100% are made in such an order, the spool valve 80 is held at the advancing angle position as shown in FIG. 3, the oil is supplied to the bore 25 by way of the passages 21, 63*b*, and 63*c*, the annular grooves 82 and 65, the passage 68, the annular groove 69, the passage 22*a*, the axial groove 26 and 34, and the bore 27. A time duration is required for increasing the pressure of the oil in the bore 25 to a value which is enough to exclude the locking pin 100 from the bore 25 against the urging force of the spring 101. Thus, the valve timing control device is held at the locked condition in FIGS. 3 and 2, thereby preventing strike noise causes by vanes 70.

After passing the foregoing time duration which begins at the activation of the oil pump 15 subsequent to the initiation of the internal combustion engine, the oil pressure in the reservoir 25 increases supplied from the reservoir via the spool valve 80 held at the advancing angle position, which extracts the locking pin 100 from the bore 25 against the urging force of the spring 101, the looked condition is released. Then, the oil pressures in the respective advancing angle chambers R1 cause rotations of the vanes 70 and the rotor 20 which rotates together with the cam shaft 10*a* relative to the housing 30, the plate members 40 and 50, and others in the direction of the advancing angle side (the clockwise direction in FIG. 2). At this time, as previously explained, each of the retarding angle chambers R2 is in fluid communication with both of the drain passage 14 and the inner side of the front cover 40. It is to be noted that the relative rotation between the rotor 20 and the housing 30 which occurs after extraction of the locking pin 100 from the bore 25 exceeds an angle, the fluid communication between the passage 22*a* and the bore 25 is interrupted, thereby preventing the vibration of the looking pin 100 caused by the ripples of the oil under pressure.

After extraction of the locking pin 100 from the bore 25, the rotor 20 is brought into rotation relative to the rotational transmission members including the housing 30 in either of the retarding angle direction and the advancing angle direction by adjusting the pressure difference across each vane 70 or between adjacent advancing angle chamber R1 and retarding angle chamber R2. Such a pressure differential adjustment results from the fact that changing duty rate of the current to the coil 96 adjusts the oil pressures in the respective chambers R1 and R2 in a correlated manner. Thus, if the duty ratio of the current supplied to the coil 96 is set to be higher (for example 100%) depending on the running condition of the internal combustion engine, concurrent drain of the oil from the retarding angle chamber R2 and supply of the oil into the advancing angle chamber R1 are made, whereby the relative rotation between the rotor 20 and each of the rotational transmission members such as the housing 30 is established. Thus, as depicted in two-dotted line in FIG. 2, the volume of the retarding angle chamber R2 becomes the minimum (the most advanced angle position) under which the vane 70 is engaged with one circumferential side wall of the retarding angle chamber R2. If the other hand, duty ratio of the current supplied to the coil 96 is set to be lower (for example 0%), concurrent supply of the oil from the retarding angle chamber R2 and drain of the oil into the advancing angle chamber R1 are made, whereby the relative rotation between the rotor 20 and each of the rotational transmission members such as the housing 30 is established. Thus, as depicted in real line in FIG. 2, the volume of the retarding angle chamber R2 becomes the maximum (the most retarded angle position) under which the vane 70 is engaged with the other circumferential side wall of the retarding angle chamber R2. If the duty ratio is set to be 50%, as shown in FIG. 4, the spool valve 80 closes the passages 63*c* and the 66, thereby interrupting draining oil from and supplying oil into each of the chambers R1 and R2. Thus, the relative angular phase between the rotor 20 and the rotation transmission members including the housing 30 can be set arbitrarily between the most retarded angle position and the most advanced angle position.

As explained above, adjusting duty ratio of the current supplied to the coil 96 of the electromagnetic mechanism 90 allows an arbitrary relative angular phase between the rotor 20 and the rotation transmission members including the housing 30 within the range defined between the most retarded angle position and the most advanced angle position.

In the assembly process of the foregoing valve timing control device, the housing 30 to be mounted on the rotor 20 provided with the vanes 70 is so connected with plates 40 and 50 by the bolts 51 as to be in the unit structure, the resultant structure is connected to the cam shaft 10 by the bolt member 60, and the spool valve 80 is fitted in the bore 62 of the bolt member 60. Thus, the sole allows an easy mounting of the valve timing control device having the spool valve 80, which reduces the number of parts and the production cost.

In addition, for ensuring the foregoing arbitrary relative angular phase between the rotor 20 and the rotation transmission members including the housing 30 within the range defined between the most retarded angle position and the most advanced angle position, the initial position and the stroke of the spool valve 90 have to be adjusted. In the present embodiment, such adjustments are established by manipulating the axial thickness of the adjusting member 88 which is interposed between the rod 97 of the electromagnetic mechanism 90 and the distal end projection 81 of the spool valve 80. Such a manipulation can be made by loosening a bolt 87 by which the electromagnetic mechanism 90 is secured to the front cover 18 which enables relative movement therebetween. Thus, duplicate mountings of the electromagnetic mechanism 90 are avoided, thereby realizing an easy, quick mounting of the valve timing control device to the internal combustion engine.

It is to be noted that instead of the intake valves the present invention can be applied to exhaust valves the locking condition can be established when the advancing angle chamber R1 maximizes instead of when retarding angle chamber R2 maximizes, the vanes can be formed integrally with the rotor, the escaping bore and the locking pin receiving bore can be so made in any one of the rotor, the rear plate and the front plate as to be directed in the axial direction.

The invention has thus been shown and description made with reference to specific embodiments. However, it should be understood that the invention is in no way limited to the details of the illustrated structures but changes and modifications may be made without departing from the scope of the appended claims.

What is claimed is:

1. A valve timing control device associated with an internal combustion engine comprising:

a rotational member which rotates together with a cam shaft of said internal combustion engine during running thereof;

a rotation transmission member mounted on said rotational member so as to rotate relative thereto and rotating together with a crank shaft of said internal combustion engine;

a phase adjusting mechanism which adjusts a rotational phase of said rotational member relative to a rotational phase of said rotation transmission member based on a magnitude of a fluid pressure;

a regulating valve which controls the magnitude of the fluid pressure supplied to said phase adjusting mechanism;

an electromagnetic mechanism mounted to said internal combustion engine and having a pushing member, said pushing member being moved in the axial direction of the cam shaft upon activation of said electromagnetic mechanism, said regulating valve being moved upon engagement with said pushing member; and an adjusting member interposed between said pushing member and said regulating valve for adjusting the amount of the axial movement of said regulating valve.

2. The valve timing control device associated with an internal combustion engine according to claim 1, wherein the adjusting member is shaped as a substantially cylindrical cup.

3. The valve timing control device associated with an internal combustion engine according to claim 1, wherein the rotational transmission member is driven by a chain.

4. The valve timing control device associated with an internal combustion engine according to claim 1, wherein the adjusting member is further for adjusting an initial position of the pushing member and a clearance between the pushing member and the regulating valve.

5. The valve timing control device associated with an internal combustion engine according to claim 1 further comprising a connecting member accommodating therein the regulating valve, the connecting member being operatively connected to fasten the rotational member to the cam shaft.

6. The valve timing control device associated with an internal combustion engine according to claim 1, wherein the regulating valve is urgingly biased against the adjusting member by a spring.

7. The valve timing control device associated with an internal combustion engine according to claim 5, wherein the regulating valve is operatively positioned at a center portion of the connection member.

8. The valve timing control device associated with an internal combustion engine according to claim 1, wherein the pushing member, the regulating valve, and the adjusting member are lubricated.

9. The valve timing control device associated with an internal combustion engine according to claim 1, wherein the regulating valve includes a projection tip abutting the adjusting member, and the projection tip has a spherical outer surface.

10. A valve timing control device associated with an internal combustion engine comprising:

a rotational member rotating together with a cam shaft of said internal combustion engine during running thereof;

a rotation transmission member mounted on said rotational member so as to rotate relative thereto and rotating together with a crank shaft of said internal combustion engine;

a phase adjusting means for adjusting a rotational phase of said rotational member relative to a rotational phase of said rotation transmission member based on a magnitude of a fluid pressure;

a regulating means for controlling the magnitude of the fluid pressure supplied to said phase adjusting means;

an electromagnetic means mounted to said internal combustion engine, for selectively engaging and thereby axially moving the regulating means along an axis of the cam shaft, the electromagnetic means having a pushing means for engagingly contacting with the regulating means in axially moving the regulating means; and an adjusting means interposed between said pushing means and said regulating means, for adjusting the amount of the axial movement of said regulating means.

11. The valve timing control device associated with an internal combustion engine according to claim 10, wherein the adjusting means includes a substantially cylindrical cup operatively connected to an end portion of the pushing means.

12. The valve timing control device associated with an internal combustion engine according to claim 10, wherein the rotational transmission member is driven by a chain.

13. The valve timing control device associated with an internal combustion engine according to claim 10, wherein the adjusting means is further for adjusting an initial position of the pushing means and a clearance between the pushing means and the regulating means.

14. The valve timing control device associated with an internal combustion engine according to claim 10 further comprising a connecting means formed to accommodate therein the regulating valve and for fastening the rotational member to the cam shaft.

15. The valve timing control device associated with an internal combustion engine according to claim 10, wherein the regulating means includes a valve element urgingly biased against the adjusting means by a spring.

16. The valve timing control device associated with an internal combustion engine according to claim 14, wherein the regulating means includes a valve element accommodated in a center portion of the connection means.

17. The valve timing control device associated with an internal combustion engine according to claim 10, wherein the regulating means includes a valve element having a projection tip for contacting the adjusting means, and the projection tip has a spherical outer surface.

* * * * *